US010091843B1

(12) United States Patent
Janning

(10) Patent No.: US 10,091,843 B1
(45) Date of Patent: Oct. 2, 2018

(54) CHRISTMAS TREE WITH DC OUTLETS FOR POWERING LED LIGHT STRINGS

(71) Applicant: JLJ, Inc., Bellbrook, OH (US)

(72) Inventor: John L. Janning, Bellbrook, OH (US)

(73) Assignee: JLJ, Inc., Bellbrook, OH (US)

( * ) Notice: Subject to any disclaimer, the term of this patent is extended or adjusted under 35 U.S.C. 154(b) by 0 days.

(21) Appl. No.: 15/913,244

(22) Filed: Mar. 6, 2018

Related U.S. Application Data

(60) Provisional application No. 62/626,229, filed on Feb. 5, 2018, provisional application No. 62/627,885, filed on Feb. 8, 2018.

(51) Int. Cl.

| | |
|---|---|
| ***H05B 33/08*** | (2006.01) |
| ***A47G 33/06*** | (2006.01) |
| ***F21V 23/06*** | (2006.01) |
| *F21Y 115/10* | (2016.01) |
| *F21W 121/04* | (2006.01) |

(52) U.S. Cl.
CPC ..... *H05B 33/0809* (2013.01); *A47G 33/06* (2013.01); *F21V 23/06* (2013.01); *H05B 33/0845* (2013.01); *F21W 2121/04* (2013.01); *F21Y 2115/10* (2016.08)

(58) Field of Classification Search
CPC ..... H05B 33/0815; H05B 33/0818; H05B 33/0845; A47G 33/06; F21V 23/06
See application file for complete search history.

(56) References Cited

U.S. PATENT DOCUMENTS

| | | | | |
|---|---|---|---|---|
| 8,569,960 | B2 | 10/2013 | Chen | |
| 8,974,072 | B2 | 3/2015 | Chen | |
| 9,781,792 | B1 | 10/2017 | Janning | |
| 2003/0198048 | A1* | 10/2003 | Frederick | H05B 39/00 362/249.01 |
| 2009/0128046 | A1 | 5/2009 | Tsai | |
| 2012/0076957 | A1* | 3/2012 | Chen | F21V 21/002 428/8 |
| 2014/0042903 | A1 | 2/2014 | Altamura | |
| 2014/0075836 | A1* | 3/2014 | Buck | A01G 17/04 47/42 |
| 2014/0111101 | A1* | 4/2014 | McRae | H05B 33/0806 315/186 |
| 2015/0091454 | A1* | 4/2015 | McRae | H05B 37/0272 315/186 |
| 2015/0102731 | A1* | 4/2015 | Altamura | H05B 33/0821 315/152 |
| 2016/0081508 | A1 | 3/2016 | Wong | |

(Continued)

*Primary Examiner* — Douglas W Owens
*Assistant Examiner* — Syed M Kaiser
(74) *Attorney, Agent, or Firm* — Blank Rome LLP

(57) ABSTRACT

An artificial Christmas tree with substantially unfiltered, full wave rectified pulsating DC voltage supplied to a plurality of female outlets disposed on the outside of the trunk of the tree. Alternatively, a power distribution strip, mountable on the tree, provides the full wave rectified pulsating DC power. The female outlets of the pre-wired tree or the power distribution strip receive the male plugs of "naked" LED light strings, which do not have female end connector plugs or power conversion circuitry. The LED light strings have only two wires and are powered by the full wave rectified and substantially unfiltered pulsating DC voltage. Dimming circuitry may be provided to dim the light output of the LED light strings.

13 Claims, 4 Drawing Sheets

(56) References Cited

U.S. PATENT DOCUMENTS

| | | | | |
|---|---|---|---|---|
| 2016/0360914 | A1* | 12/2016 | Austin | F21V 33/0028 |
| 2017/0164774 | A1* | 6/2017 | Chen | A47G 33/06 |
| 2017/0238639 | A1* | 8/2017 | Chen | A41G 1/005 |
| 2017/0241630 | A1* | 8/2017 | Chen | F21V 23/001 |
| 2017/0303374 | A1* | 10/2017 | Altamura | F21V 23/06 |
| 2017/0311744 | A1* | 11/2017 | Chen | A47G 33/08 |
| 2017/0340156 | A1* | 11/2017 | Ocegueda Gallaga | A47G 33/06 |

* cited by examiner

CHRISTMAS TREE WITH DC OUTLETS FOR POWERING LED LIGHT STRINGS

This application claims the benefit of Provisional Application No. 62/626,229, filed on Feb. 5, 2018 and Provisional Application No. 62/627,885, filed on Feb. 8, 2018.

FIELD OF THE INVENTION

The present invention relates to a pre-wired artificial Christmas tree with multiple DC outlets disposed on the outside of the trunk of the tree, or, alternatively a DC power distribution strip mountable on a Christmas tree, adapted to receive and power simple, inexpensive two-wire LED light strings.

BACKGROUND OF THE INVENTION

Artificial Christmas trees today, for the most part, are pre-wired with conventional LED light strings, and are known as artificial pre-lit LED Christmas trees. In most cases, the conventional LED light strings used in pre-lit trees are plugged into an AC outlet within the center trunk of the tree. Conventional LED light strings include power conversion circuitry to convert the 120 volts AC house current to DC voltage, which requires four or even five wires running through the string. Moreover, conventional LED light strings have female plug end connectors to allow multiple strings to be connected together, and thus include high gauge wire to handle the larger currents drawn by multiple series-connected light strings.

It would be desirable to provide an artificial Christmas tree provided with DC power outlets and adapted to use simple, inexpensive two-wire LED light strings that can be plugged into the tree. Alternatively, it would be desirable to provide a flexible power distribution strip with AC to DC conversion circuitry that can be mounted on a Christmas tree to power inexpensive two-wire LED light strings.

SUMMARY OF THE INVENTION

The present invention provides a new way to power LED light strings mountable on Christmas trees. Advantageously, the pre-wired Christmas tree of the present invention is adapted to be used with simple, inexpensive LED light strings having only two wires for full wave low flicker operation. The present invention alternatively provides a power distribution strip, mountable on a Christmas tree, for supplying pulsating DC power to inexpensive, two-wire LED light strings.

More specifically, the present invention is a pre-wired artificial Christmas tree with an unfiltered, full wave rectified pulsating DC voltage supplied through a trunk of the tree to a plurality of female outlets disposed on the outside of the trunk of the tree. The female outlets of the pre-wired tree receive the male plugs of "naked" LED light strings, which do not have female end connector plugs or power conversion circuitry. The LED light strings have only two wires and are powered by the full wave rectified pulsating DC voltage. Dimming circuitry is provided to dim the light output of the LED light strings.

Alternatively, the present invention provides a flexible DC power distribution strip mountable on the outside of the trunk of a Christmas tree and secured to the trunk of the tree with straps or other means. The female outlets of the power distribution strip receive the male plugs of "naked" LED light strings. The power distribution strip includes a full wave rectifier bridge to convert AC to DC power or, optionally, is used with dimmer circuitry provided in a separate box along with the AC to DC bridge rectifier connected.

Advantageously, using light strings with only two wires and without end female connector plugs reduces the cost of the light strings significantly.

Other advantages, variations and other features of the invention will become apparent from the drawings, the further description of the preferred embodiments of the invention, and the claims to follow.

DETAILED DESCRIPTION OF THE PREFERRED EMBODIMENTS

Figure 1:
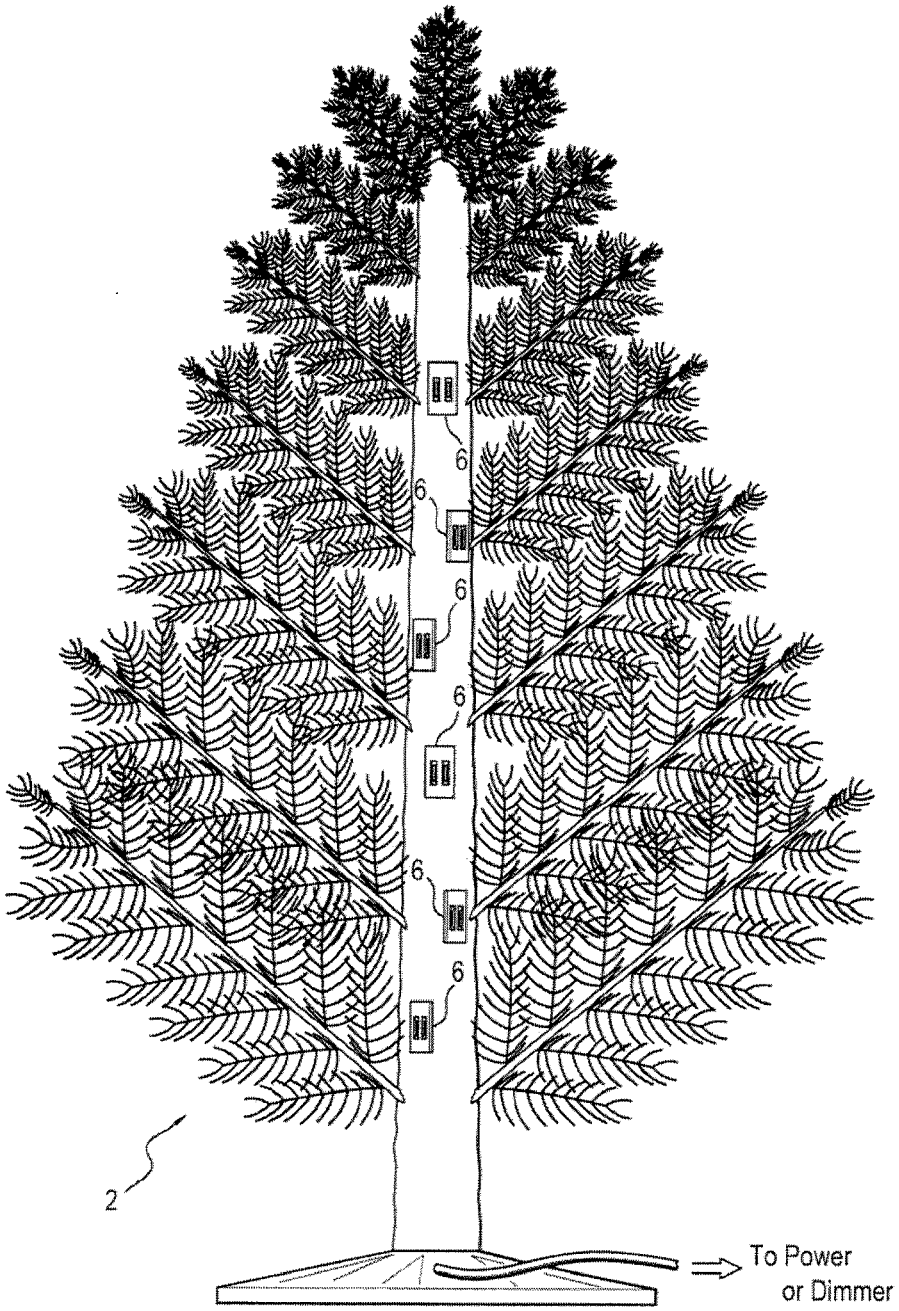
FIG. 1 shows the basic pre-wired artificial Christmas tree of the present invention, provided with multiple outlets for receiving male plugs of low cost LED light strings.

Referring to FIG. 1, the pre-wired artificial Christmas tree 2 of the present invention is similar to that described in U.S. Pat. No. 9,781,792, incorporated herein by reference. The power running up the tree is DC. Full wave rectified DC power is preferred as it avoids flickering of the LEDs in the light strings. Advantageously, the artificial Christmas tree of the present invention can use low cost LED light strings 4, shown in FIG. 2, which have only two wires and do not have the customary female end connector plug for connecting multiple strings together. Using light strings without female end connector plugs reduces the cost of the light strings. Moreover, since the light strings that can be used without end plugs are limited in their current drain, wire size in these strings can be reduced, resulting in significant cost savings. With 40 clear warm white LEDs in a series wired string, 22 gauge wire can be used. If colored LEDs are used, 50 LEDs can be put in a series wired string. Preferably, DC output from a bridge rectifier, through a triac dimmer, is supplied up the trunk of the tree.

Figure 3:
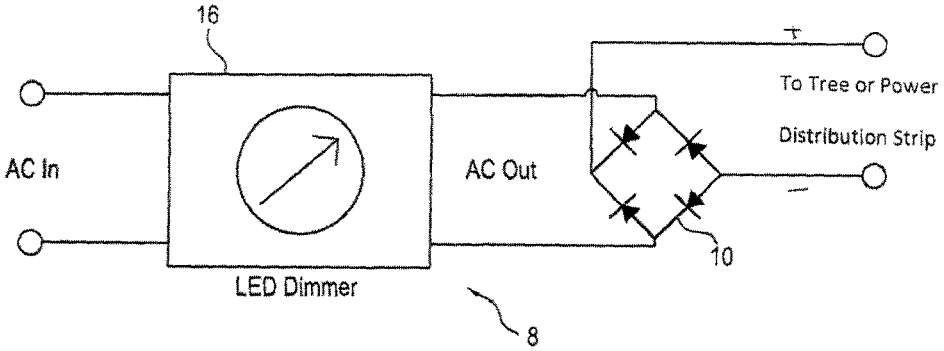
FIG. 3 shows the power box for generating full wave rectified DC voltage, along with a triac dimmer, or other LED dimming circuitry known to those skilled in the art for adjusting the brightness of the light emitted from the LED light strings.

Multiple basic LED light string circuits 4 may be strung on the Christmas tree and are plugged into respective female outlets 6 disposed on the trunk of the tree. The consumer can distribute the lights more on the front of the tree than on the back facing the wall. The female outlets 6 are all connected in parallel and connected to a power box 8 at the bottom of the tree or in the main power plug of the tree. As shown in FIG. 3, in the power box or in the main plug is a bridge rectifier 10 converting the 120 volt house power into D.C. (direct current) to power the light strings with full wave rectification.

The operating power—the output of the bridge rectifier 10, which is unfiltered pulsating DC, is sent through the triac dimmer or similar dimming circuitry known to those skilled in the art, and then sent up the center trunk of the tree to female outlets 6, preferably at least 10 female outlets, one every three to eight inches along the height of the tree trunk. An advantage of the present invention over a conventional pre-lit tree is that, in stringing lights on the pre-wired tree of the present invention, one can avoid having too many lights on the side of the tree facing the wall. On a conventional pre-lit tree, the lights are spaced uniformly around the tree.

Figure 2:
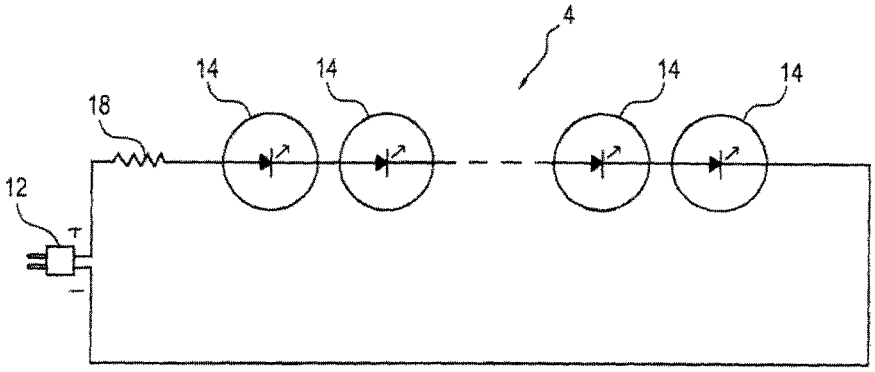
FIG. 2 shows the simple circuit of a low cost LED light string which can be plugged into the pre-wired artificial Christmas tree of the present invention.

Light strings 4 are connected to the female outlets 6 of the tree via male plugs 12. The light strings as shown in FIG. 2 are "naked" regarding power conversion. They have no operating power conversion circuitry to convert the 120 volts AC house current to DC voltage required to operate the LEDs 14. This results in a significant cost savings in that only two wires are needed for operation. The spacing of LEDs 14 on the light string is preferably about six inches, as opposed to the standard spacing of four inches on conventional LED light strings. The total number of LEDs in each series wired light string is 40 for clear lights and 50 for colored lights. The series resistance 18 is optional.

As shown in FIG. 3, bridge rectifier 10 may be provided with appropriate dimming circuitry, such as a triac dimmer 16, to variably adjust the brightness of the LEDs in the light strings. The triac dimmer 16 features pulse width modulation to vary the on time of the AC input voltage wave and thereby vary the pulse width of the pulsating DC output from rectifier 10, which varies the brightness of the LEDs in the light strings. Most LED dimmers use (PWM) pulse width modulation.

Figure 4:
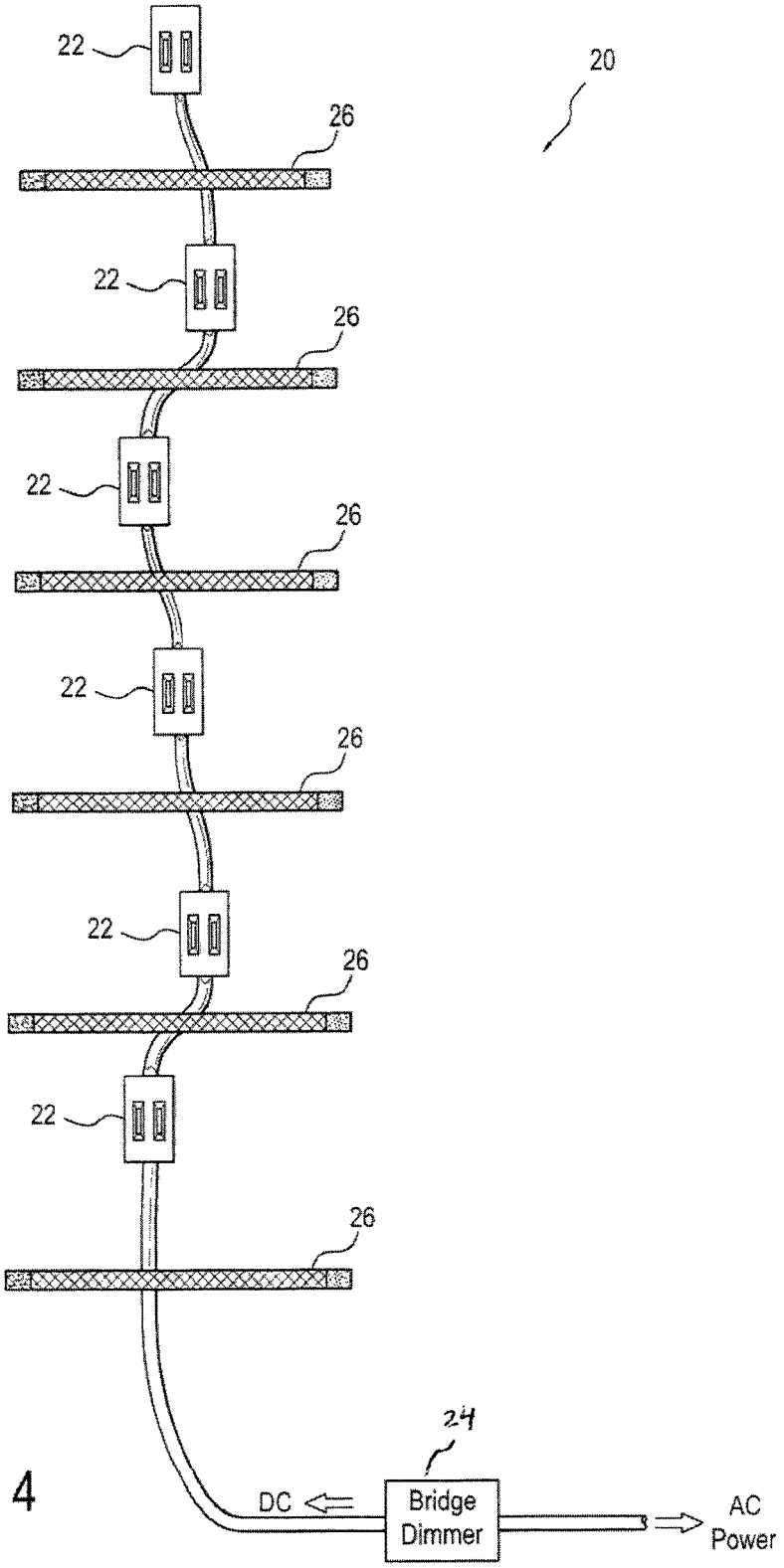
FIG. 4 shows a flexible DC power distribution strip which includes a full bridge rectifier circuit for converting AC power to pulsating DC power.

Referring to FIG. 4, in an alternative embodiment, the present invention comprises a flexible power distribution strip 20, with spaced female outlets 22 and with a built-in full wave bridge rectifier at the bottom end for converting AC to pulsating DC power. The power distribution strip is preferably flexible, so it can be rolled up for packaging, distribution and storage. The flexible power distribution strip 20 may be provided with triac dimmer circuitry, in which case the dimmer circuitry and the full wave bridge rectifier are located in a separate power box 24, preferably several five feet away from the strip. The dimmer circuitry can be adjusted manually, or by remote control.

Figure 5:
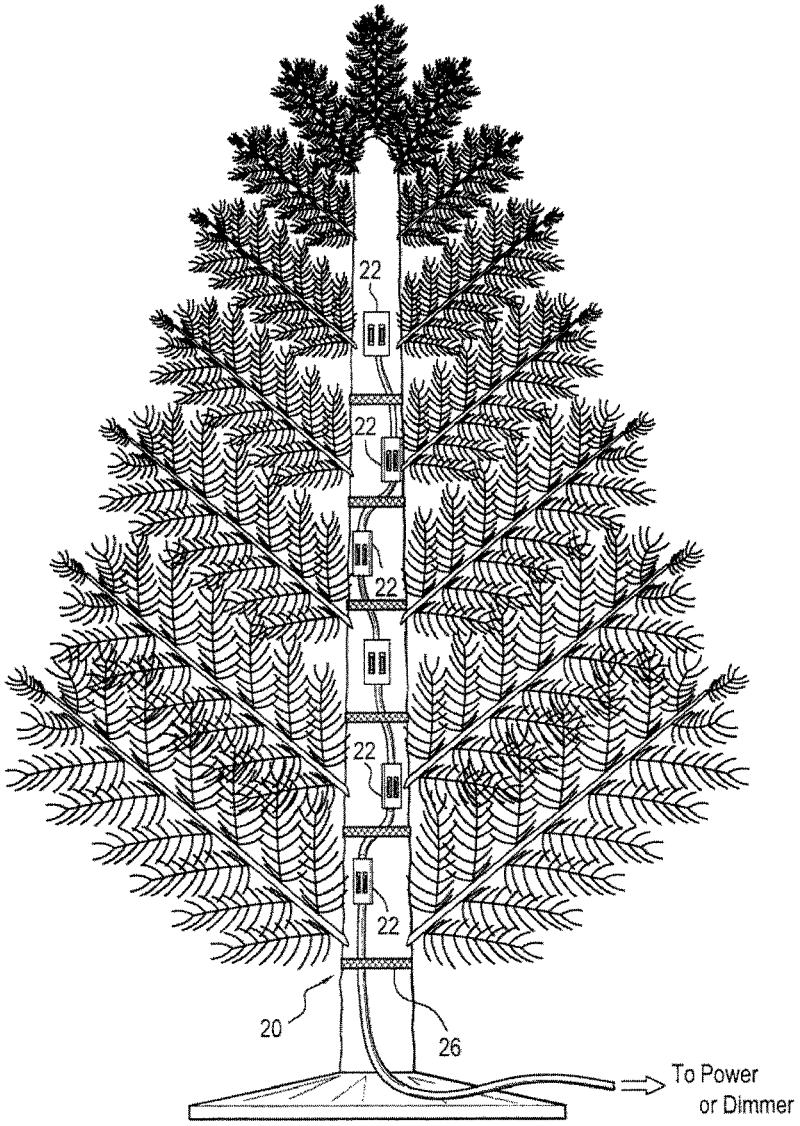
FIG. 5 shows an artificial Christmas tree with the flexible DC power distribution strip of FIG. 4 mounted on the tree.

As shown in FIG. 5, the power distribution strip is mountable on the trunk of a Christmas tree, either a live or artificial tree, and is preferably secured to the tree with straps 26, e.g., Velcro straps.

Accordingly, the present invention provides the following important features over the prior art:

The prewired artificial Christmas tree and power distribution strip of the present invention are specially designed to be used with low cost, two wire LED light strings consisting of "naked" series connected LEDs, void of any operating power conversion circuitry. Operation of the light string is full wave DC and is low flicker.

Presently, light strings used in pre-lit Christmas trees have conversion circuitry to convert the 120 volt AC source to DC—which is necessary to operate LEDs. Some conventional strings contain four or even five wires. The pre-wired artificial Christmas tree and power distribution strip of the present invention can advantageously be used with light strings having only two wires because the AC to DC conversion is done externally to the string.

The "naked" LED light strings used with the pre-lit artificial Christmas tree or the power distribution strip of the present invention may have a series current limiting resistor 18 with a resistance between zero and 1000 Ohms. The series wired string of LEDs may also contain a diode (not shown) for reverse voltage protection. The male receptacle plugs of the light string may be provided with polarity identification marks to ensure that the light string is plugged into the female outlets of the pre-wired artificial Christmas tree or power distribution strip of the present invention in the correct orientation.

Although the invention has been described in detail in connection with the exemplary embodiments, it should be understood that the invention is not limited to the above disclosed embodiments. Rather, the invention can be modified to incorporate any number of variations, alternations, substitutions, or equivalent arrangements not heretofore described, but which are commensurate with the spirit and scope of the invention. Accordingly, the invention is not limited by the foregoing description or drawings, but is only limited by the scope of the appended claims.

What is claimed is:

1. An artificial Christmas tree with a full wave rectifier for generating a substantially unfiltered, full wave rectified pulsating DC voltage to a plurality of female outlets disposed on the outside of the trunk of the artificial Christmas tree, the female outlets being adapted to receive male plugs of LED light strings, wherein the LED light strings have only two wires, have no female end connector plugs, and are powered by the full wave rectified pulsating DC voltage generated by the full wave rectifier, the artificial Christmas tree comprising dimming circuitry comprising a triac dimmer connected to the full wave rectifier for continuously varying the full wave rectified pulsating DC voltage to dim the LED light strings by varying the pulse width of the full wave rectified pulsating DC voltage output from the full wave bridge rectifier.

2. The artificial Christmas tree as recited in claim 1, wherein the full wave rectified pulsating DC voltage is supplied through wires running through the trunk of the artificial Christmas tree, and the female outlets are built into the trunk of the tree.

3. The artificial Christmas tree as recited in claim 1, comprising at least 10 female outlets, spaced every three to eight inches along the height of the trunk of the artificial Christmas tree.

4. The artificial Christmas tree as recited in claim 1, wherein the LED light strings are provided with LEDs spaced approximately six inches apart.

5. The artificial Christmas tree as recited in claim 1, and at least one of the LED light strings plugged into the artificial Christmas tree and powered by the full wave rectified pulsating DC voltage.

6. A DC power distribution strip attachable to the outside of a trunk of a Christmas tree, comprising:

a plurality of female outlets adapted to receive male plugs of LED light strings, wherein the LED light strings have only two wires, have no female end connector plugs, and are powered by full wave rectified pulsating DC voltage;

a full wave bridge rectifier for generating the full wave rectified pulsating DC voltage from an AC power source;

circuitry for distributing the full wave rectified pulsating DC voltage from the full wave bridge rectifier to the female outlets of the DC power distribution strip; and dimming circuitry comprising a triac dimmer for continuously varying the full wave rectified pulsating DC voltage to dim the LED light strings by varying the pulse width of the full wave rectified pulsating DC voltage output from the full wave bridge rectifier.

7. The DC power distribution strip as recited in claim 6, further comprising means for attaching the DC power distribution strip vertically onto the outside of the trunk of a Christmas tree.

8. The DC power distribution strip as recited in claim 7, wherein the means for attaching the DC power distribution strip onto the outside of the trunk of the Christmas tree comprises hook and loop fastener straps.

9. The DC power distribution strip as recited in claim 6, wherein the dimming circuitry is disposed in a separate power box with the full wave bridge rectifier.

10. The DC power distribution strip as recited in claim 6, comprising at least 10 female outlets, spaced about three to eight inches along the length of the strip.

11. The DC power distribution strip as recited in claim 6, wherein the LED light strings are provided with LEDs spaced approximately six inches apart.

12. The DC power distribution strip as recited in claim 6, mounted on the Christmas tree, and at least one of the LED light strings plugged into the tree and powered by the full wave rectified pulsating DC voltage.

13. An artificial prelit Christmas tree, comprising: a full bridge rectifier for generating a full wave rectified pulsating DC voltage from an AC input voltage; a plurality of LED light strings mounted on the tree and powered by the full wave rectified pulsating DC voltage, the LED light strings having only two wires and no end female connector plugs; and dimming circuitry, connected to the full wave bridge rectifier, for varying the pulsating DC voltage to dim the LED light strings mounted on the tree, the dimming circuitry comprising a triac dimmer with pulse width modulation to vary the on time of the AC input voltage and thereby vary the pulse width of the pulsating DC voltage output from full bridge rectifier, thereby varying the brightness of the LEDs in the LED light strings.

* * * * *